United States Patent [19]

Wisner et al.

[11] Patent Number: 4,483,635

[45] Date of Patent: Nov. 20, 1984

[54] PAPER GUIDE FOR PRINTERS

[75] Inventors: Ingo Wisner, Remchingen; Adolf Bley, Pforzheim, both of Fed. Rep. of Germany

[73] Assignee: International Standard Electric Corporation, New York, N.Y.

[21] Appl. No.: 436,248

[22] Filed: Oct. 25, 1982

[30] Foreign Application Priority Data

Oct. 28, 1981 [DE] Fed. Rep. of Germany ..... 3142700

[51] Int. Cl.[3] ..... B41J 11/66; B41J 15/16; B41J 13/036; B41J 13/16

[52] U.S. Cl. ..... 400/642; 400/621; 400/639

[58] Field of Search ..... 400/621, 637–639.2, 400/631, 642

[56] References Cited

U.S. PATENT DOCUMENTS

| | | | |
|---|---|---|---|
| 1,216,857 | 2/1917 | Shamme | 400/644 |
| 1,513,284 | 10/1924 | Sinclair | 400/621 |
| 1,694,519 | 12/1928 | Smith | 400/621.2 |
| 2,241,357 | 5/1941 | Paschke | 400/621 |
| 2,399,369 | 4/1946 | McFarland | 400/621 |
| 2,555,728 | 6/1951 | Bradt | 400/621 |
| 2,566,930 | 9/1961 | Crumrine | 400/639.2 |
| 2,807,346 | 9/1957 | Davidson et al. | 400/621 |
| 2,808,919 | 10/1957 | Frobel | 900/621 |
| 3,212,617 | 10/1965 | Sngiyama | 400/621 |
| 3,339,696 | 9/1967 | Toeppen | 400/639.2 |
| 4,042,091 | 8/1977 | Levinson et al. | 400/639.1 |

FOREIGN PATENT DOCUMENTS

| | | | |
|---|---|---|---|
| 2946033 | 5/1981 | Fed. Rep. of Germany | 400/631 |
| 3009001 | 9/1981 | Fed. Rep. of Germany | 400/54 |

*Primary Examiner*—William Pieprz

*Attorney, Agent, or Firm*—T. E. Kristofferson; A. D. Stolzy; J. M. May

[57] ABSTRACT

Above the platen and throughout the entire width of the paper guide, the back of a guide member which is inclined in the direction of the paper eject, is firmly arranged. On bolts in the end faces pairs of levers are swivel mounted which, via tooth segments, lie in engagement with one another. Between each of the levers there is arranged a tension spring. The front levers are in connection with one another by a shaft on which pressure rolls are seated. Between the levers and firmly connected thereto, there is arranged a paper-tearing device. The rearward levers are provided with oblong holes in which a rod is resiliently supported.

2 Claims, 4 Drawing Figures

PAPER GUIDE FOR PRINTERS

BACKGROUND OF THE INVENTION

This invention relates to printers, and more particularly to a paper guide therefor.

PRIOR ART STATEMENT

A paper guide of the aforementioned type is known from a printer well established in the market (LO 2000 teleprinter of Standard Elektrik Lorenz AG). In that type of printer, a stripper rod is firmly arranged closely above an arched paper deflector. Following the threading of the paper web coming from the paper supply roll, the paper web must be bent off downwardly towards the paper run-in between the paper deflector and the platen. In the case of multi-ply (multi-part form) paper, this is entailed by difficulties, because this type of paper tends to fan out. On account of this it may happen that the individual plies are not seized uniformly by the paper feed facility. As a consequence, the plies are displaced with respect to one another. A similar problem is caused by the firm assignment of the paper-tearing device to a paper eject, between which the paper web has to be passed. The paper-tearing device is arranged above the shaft of the pressure rolls. Between both there exists a defined spacing. Experience has shown, that already in the event of a slight jamming of the paper web within the area of the paper eject, it may happen that the paper web becomes arched and, between the pressure rolls and the paper-tearing device, enters in the form of a loop into the machine space.

SUMMARY OF THE INVENTION

According to the present invention, there is provided in a printer, the combination comprising: a paper guide for printers in which a paper web, via a resiliently supported shock-absorbing and stripper rod, is fed to a platen by partly surrounding the latter, and with the application thereof to the platen in the lower part being secured by a resiliently applied pressure plate and, in the upper part, by pressure rolls seated on a shaft mounted in levers resiliently supported laterally above the platen and which are capable of being tilted into a lifted off position, and in which, above the pressure rolls, there is arranged a paper-tearing device extending parallel in relation to the paper eject throughout the width of the platen, characterized in that the paper-tearing device is arranged between the levers and positively connected thereto, that said levers, via tooth segments, are in a swivel-type engagement with other levers pointing in the backward direction, that in said levers a rod is resiliently supported transversely in relation to the paper path, and that one draw spring each is arranged between said pairs of levers.

The advantages achievable by the invention reside above all in that for the run-in of a new paper web, the paper guide can be opened with a handle by one hand and in that, together with the lifting of the pressure rolls, also the paper-tearing device and the rearward, spring-borne rod are swivelled out of the paper guide area. This substantially simplifies the run-in of the paper web. The paper-tearing device is angled off in its lower part in a direction towards the shaft of the pressure rolls and extends closely up to the shaft. Accordingly, the paper web is safely guided while changing from the platen to the back plate of the guide and, in the course of this, is slightly arched. This also effects a considerable damping of the printer noises which, via the paper web, are led to the outside. A further advantage is to be seen in the wedge-shaped gap as formed by the rearward leg of the guide body and the guiding trough. In the case of multi-ply paper this prevents the paper from fanning out. At the same time, the slot prevents any larger foreign matter from sliding between the guiding trough and the platen by which the latter might easily be damaged.

BRIEF DESCRIPTION OF THE DRAWINGS

In the accompanying drawings which illustrate exemplary embodiments of the present invention.

DESCRIPTION OF THE PREFERRED EMBODIMENT

Figure 1:
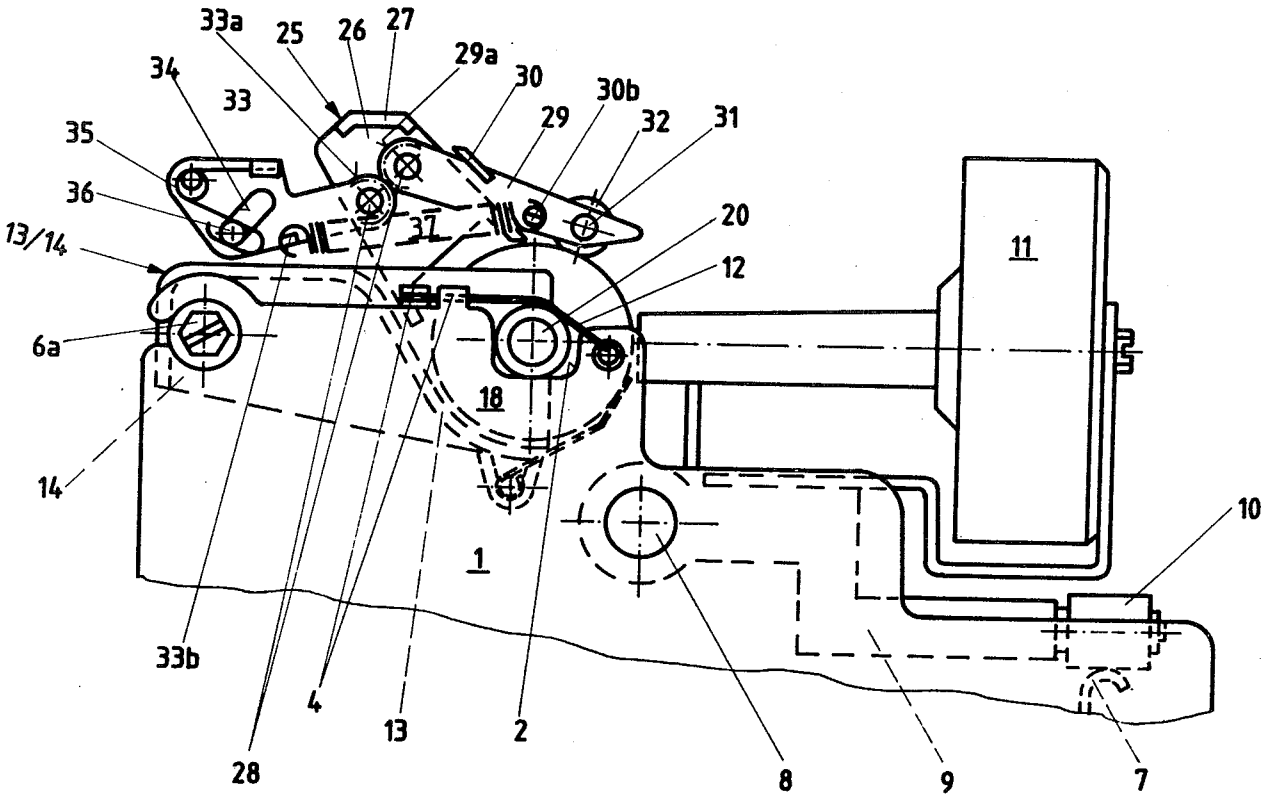
FIG. 1 is a broken away side elevational view of a serial printer with a paper guide constructed in accordance with the present invention.
Figure 2:
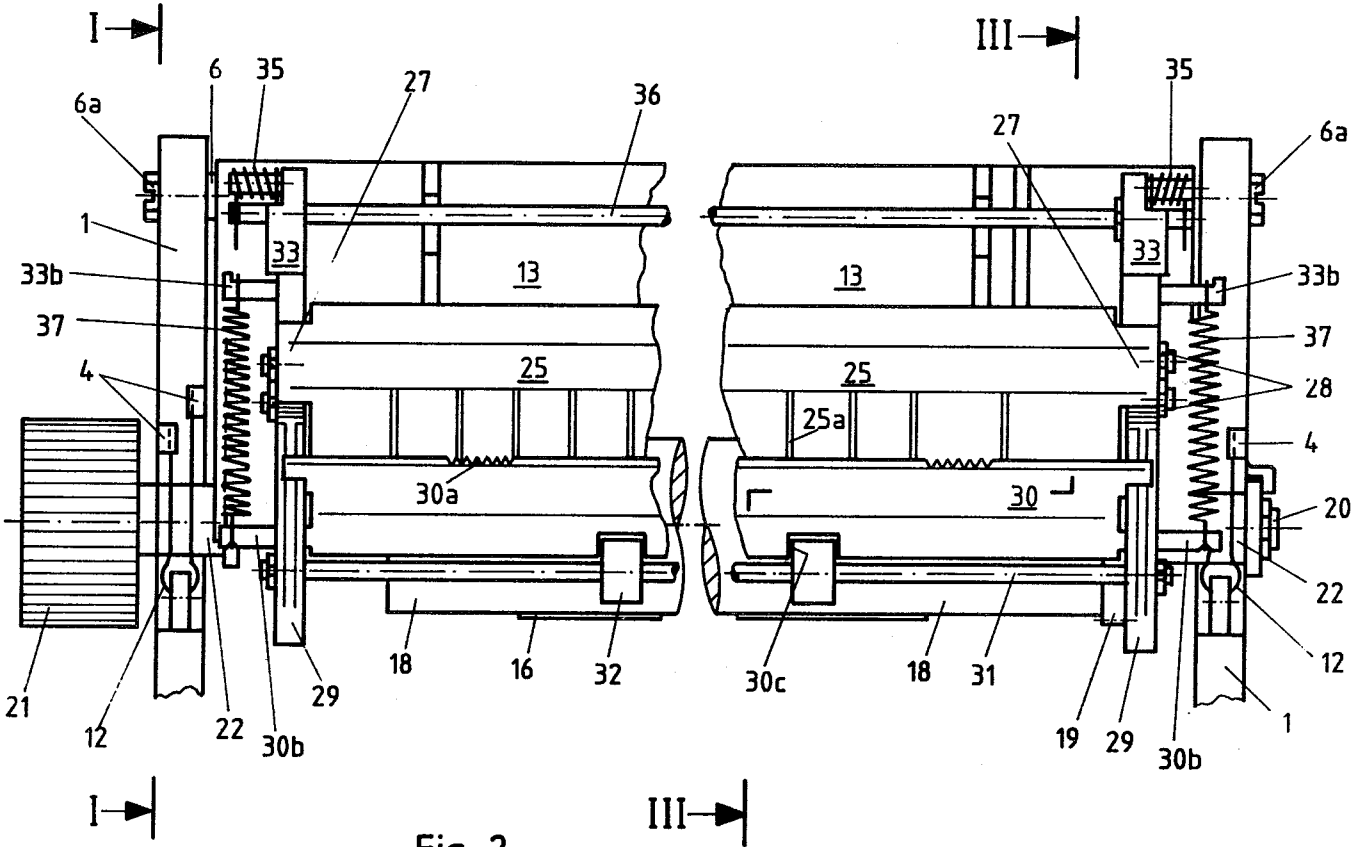
FIG. 2 is a top plan view of the printer and paper guide of FIG. 1.

FIG. 1 shows a serial printer in a schematic representation and is seen from the side. Between two side panels 1 which are spaced apart by two cross members 6 and 7, there is arranged a printing mechanism comprising a print head 11 capable of being moved along a platen 18. The print head 11 is mounted on a printing mechanism carriage 9 which is positively guided on a bearing shaft 8 which, in turn, is seated in the side panels 1. The cross member 7 is designed to have the shape of a guiding skid extending parallel in relation to the bearing shaft 8. On this the carriage 9 of the printing mechanism rests via a guide roller 10. The cross member 6 (FIG. 2) is firmly secured to the side panels 1 by means of screws 6*a*. This cross member has a circular cross section. On this cross member 6 a supporting frame 13/14 is slewably supported and bears the entire paper guide including the platen 18. The side members 14 of the supporting frame 13/14, at the ends opposite the center of rotation, are provided with fork-shaped openings 15 (FIG. 3*a*) for accepting the platen 18 with the guide bushes 22 slipped onto the bearing journals 20 of its shaft (FIG. 2). These fork-shaped openings 15 are in correspondence with recesses 2 which are open towards above, and provided for in the side panels 1. The platen 18 or the guide bushes 22 respectively, are mounted in the side panels 1 by means of hairpin shaped tension springs 12 which are slewably supported on one side and, with their free ends, are clamped below retaining claws 4 arranged on the top side of the side panels 1, as can be from FIG. 2. This portion of the paper guide forms the subject matter of (the applicant's earlier) German Patent Application No. P 31 36 192.7.

As can be seen from FIG. 2 in connection with FIG. 1 of the drawings, the back of a guide member 25 is arranged above the platen 18, which extends throughout the entire width of the platen and is inclined in the paper-eject direction. Via face surfaces 26 at the end sides, it is firmly arranged on the paper guiding through 13 of the supporting frame 13/14. These face surfaces 26 are provided with bolts 28 on which levers 29 and 30 are pivotally mounted. The levers 29 and 33, concentrically in relation to the bearing bore, are provided with a tooth segment 29*a* or 33*a* respectively, via which they are in engagement with one another. A shaft 31 serves to connect the front levers 29 with one another. On this shaft, pressure rolls 32 are seated. Above this shaft 31, and between the levers 29, there is arranged a paper-tearing device 30 having a serrated tearing edge 30*a*, arranged positively in the levers 29. The paper-tearing device 30 extends almost up to the shaft 31. The lower edge thereof is provided with indentations 30*c* into which the pressure rolls 32 project and are laterally guided therein. The paper-tearing device 30, below its center, is angled off in such a way that in the operating position of the levers 29 as shown in FIG. 1, the upper portion of the paper-tearing device 30 extends parallel in relation to the front surface of the back of the guide member 25, while the lower part thereof is in alignment with the shaft 31, as can be recognized from FIGS. 3*a* and 3*b*.

Figure 3A:
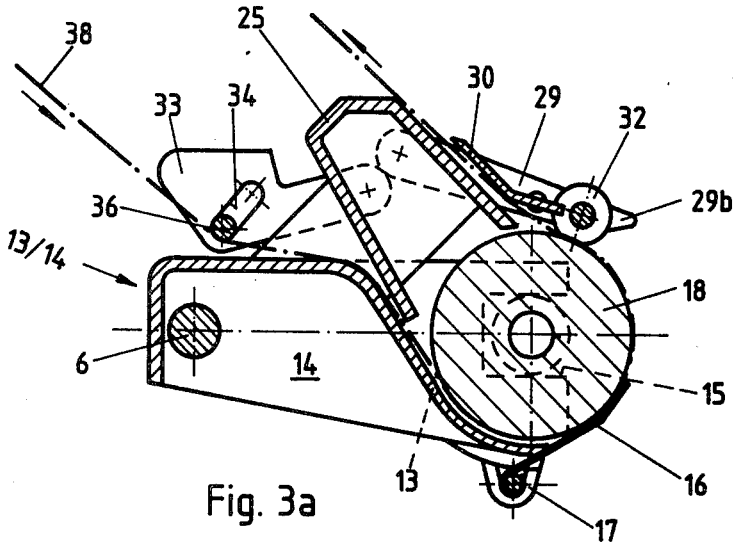
FIGS. 3*a* and 3*b* are transverse sectional views of the printer and paper guide of FIGS. 1 and 2, respectively, taken on line III—III of FIG. 2, in the operating state (FIG. 3*a*) and in the state in which the paper web can be run in (FIG. 3*b*).

The rearward levers 33 are provided with oblong holes 34 which are substantially directed transversely in relation to the paper path (38, FIG. 3*a*). In these oblong holes 34 there is guided a rod 36. Seated on the levers 33 are torsion springs 35 by which the rod 36 is urged into the extreme stop position. Between the spring bearings 33*b* on the levers 33 and the spring bearings 30*b* which, by forming part of the paper-tearing device 30, project on both sides over the levers 29, there is tensioned one draw spring 37 each. In the operating position as shown in FIG. 1, this spring takes care of that the pressure rolls 32 are resiliently applied to the platen 18 or the paper web 38 surrounding it, respectively (FIG. 3*a*). With the levers 29 in this position, the levers 33 assume the position in which they are closely above the paper-guiding trough 13 without touching the same. The redirecting rod 36, by maintaining a small spacing, extends parallel in relation to the paper-guiding trough 13. Above the bearing bolts 28, a limit stop 27 projects on both sides into the swivel range of the levers 29 and 33. Against this limit stop, the two levers 29 and 33 meet when in the uptilted position as shown in FIG. 3*b*, by being acted upon by the draw springs 37 as arranged on both sides.

On the shaft of the platen 18 there is firmly seated a toothed driving wheel 19. In the position as shown in FIGS. 1 and 2, this toothed driving wheel 19, via at least one further toothed wheel, is in connection with a stepping motor via which the line spacing is effected. On one shaft journal 20, a handwheel 21 is seated for permitting the manual rotation of the platen 18.

Figure 3B:
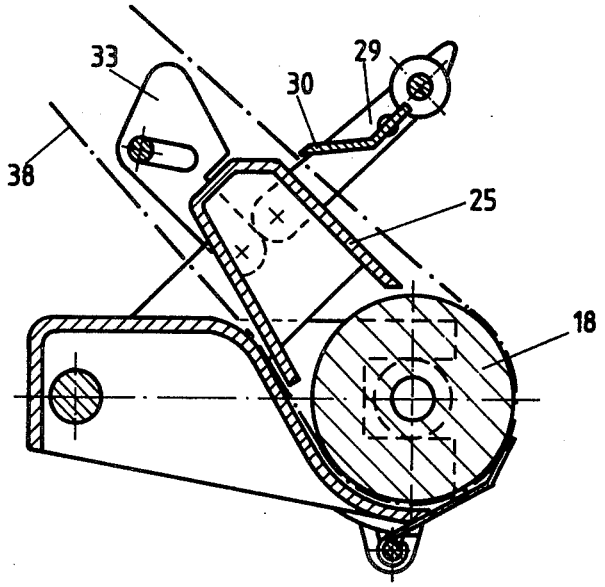

In FIGS. 3*a* and 3*b* the paper guide is shown in a sectional view taken on line III—III of FIG. 2. This representation permits to recognize the cross sectional shape of the supporting frame 13/14 and of the back of the guide member 25. The paper-guiding trough 13 of the supporting frame 13/14 extends to below the center of the platen 18. Adapter bearings 17 on the side take care of a resilient mounting of a pressure plate 16 of the type known per se, which is resiliently applied to the platen 18. As already mentioned hereinbefore, the back of the guide member 25 which is of U-shaped cross section, is inclined in the direction of the paper eject. The front surface ends closely over the center of the platen 18. It is aligned in such a way that the upper part of the paper-bearing device 30, when the levers 29 are in the position as shown in FIG. 1, forms a parallel gap with the aforementioned surface (FIG. 3*a*). Longitudinal ribs 25*a* (FIG. 2) prevent the paper web 38 from getting stuck in the event of static charges. The rearward surface of the back of the guide member 25, together with the portion of the paper-guiding trough 13 as dropping slantingly in relation to the platen 18, forms a wedge-shaped gap. This gap prevents larger articles, such as paper clips or the like, from dropping in between the paper-guiding trough 13 and the platen 18 which may cause interruptions and damages. Moreover, it is effected by the gap that a fanning-out is avoided during the run-in of multi-ply paper.

FIG. 3*a* shows the paper guide in the operating position as shown in FIG. 1 with the paper web 38 inserted. For the sake of clarity, the paper web 38 is indicated by the dot and dash line in the drawing. By the rod 36 which is resiliently supported transversely in relation to the paper path, the paper web 38 is slightly deflected. This rod 36 performs two functions. It serves as a stripper rod in the case of multi-ply paper as well as for absorbing the jerking pull motion of the paper web off the paper supply roll by the bearing in the oblong holes 34 which is spring-borne transversely in relation to the paper path. In the upper guide area, the paper web 38, after having passed the pressure rolls 32, is applied to the lower portion of the paper-tearing device 30. By the angling-off of the paper-tearing device 30 it is effected that the paper web 38 is led around the bending edge of the paper-tearing device before being led out of the paper guide through the gap between the upper portion of the paper-tearing device 30 and the front surface of the back of the guide member 25. In this way, the printer noise as transmitted via the paper web, is kept at a relatively low level.

The paper guide can be opened for the purpose of running in a paper web 38. When lifting one of the levers 29 on the front end 29*b*, the other one will follow this motion owing to the stiffening effect of the integrated paper-tearing device 30. Thanks to the positive connection via the tooth segments, the levers 33 follow this motion in a mirror-inverted manner. In the course of this, the springs 37 (FIG. 1) are further tensioned until reaching the stretched-out position. Upon exceeding the dead center, the levers 29 and 33, under the pulling action of the springs 37, are tilted upwardly and, in the course of this, as already mentioned hereinbefore, meet against the limit stops 27 (FIG. 1). This opening position is shown in FIG. 3*b* in which both pairs of levers 29 and 33 are tilted upwardly out of the area of the paper path. In this position, the paper web 38 can be freely inserted into the paper guide, and also an insertion into the paper eject between the front surface of the back of the guide member 25 and the lifted paper-tearing device 30 becomes possible in a simple way. Via one of the levers 29, the paper guide can be returned to the operating position as shown in FIG. 3*a* by only involving a simple manipulation. If this should happen to be forgotten by the operator, however, there is provided at least one resetting stop in the hood covering up the paper guide. This return stop is arranged in such a way that it, when closing the hood, will meet onto one of the uptilted levers 29, pressing it in the course of the further closing process, so far in the downward direction that the dead center position of the springs 37 is compulsorily exceeded in the downward direction. In this way it is safeguarded that the levers 29 and 33 are always in the operating position when the hood is closed.

What is claimed is:

1. In a printer, the combination comprising: a supporting frame; a platen supported on said frame; a shaft;

a forward pair of levers having rearward ends rotatably mounted on said frame and forward ends carrying said shaft; a pair of pressure rolls rotatably mounted on said shaft in a position engageable with said platen; a rearward pair of levers having forward ends rotatably mounted on said frame adjacent said forward pair of levers, a corresponding one of each pair of levers having a set of gear teeth meshed with a set of gear teeth on the other pair; a rod carried by said rearward pair of levers to tension the paper as it approaches the platen; said pairs of levers being movable between a first position in which said pressure rolls contact said platen and said rod contacts paper being fed to said platen, and a second position in which said pressure rolls are spaced from said platen and said rod is spaced from the paper, said gear teeth on said levers enabling each of said levers to be moved simultaneously in response to movement of any one of said levers; a stop to prevent said pairs of levers from rotating beyond a limit toward said second position; and a tension spring connected to corresponding ones of said pairs of levers and operating in an over-the-center manner between said first and second positions to maintain said levers stably in either of said first or second positions.

2. The invention as defined in claim 1, wherein a knife is provided, said forward pair of levers carrying said knife, said knife being mounted on top of said forward pair with the blade facing rearwardly.

* * * * *